US006506270B2

(12) United States Patent
Takashina et al.

(10) Patent No.: US 6,506,270 B2
(45) Date of Patent: Jan. 14, 2003

(54) HEAT TREATMENT METHOD OF STEEL

(75) Inventors: Kenzo Takashina, Moriyama (JP); Yuji Komori, Moriyama (JP); Kazuaki Tanaka, Akashi (JP); Masahiro Machida, Akashi (JP)

(73) Assignees: Iwatani International Corporation, Osaka (JP); MMC Kobelco Tool Co., Ltd., Akashi (JP)

( * ) Notice: Subject to any disclaimer, the term of this patent is extended or adjusted under 35 U.S.C. 154(b) by 0 days.

(21) Appl. No.: 09/883,336

(22) Filed: Jun. 19, 2001

(65) Prior Publication Data

US 2002/0017345 A1 Feb. 14, 2002

(30) Foreign Application Priority Data

Jun. 21, 2000 (JP) ..... 2000-186479

(51) Int. Cl.[7] ..... C21D 6/04

(52) U.S. Cl. ..... 148/578; 148/577; 148/517; 62/4

(58) Field of Search ..... 148/517, 577, 148/578; 62/4

(56) References Cited

U.S. PATENT DOCUMENTS 3,819,428 A 6/1974 Moore
5,259,200 A 11/1993 Kamody ..... 62/64
5,865,913 A 2/1999 Paulin
5,875,636 A 3/1999 Kamody

FOREIGN PATENT DOCUMENTS

| | | | | |
|---|---|---|---|---|
| CH | 0572983 | * | 2/1976 | ..... 148/578 |
| CH | 572 983 | | 2/1976 | |
| DE | 25 17 147 A1 | | 10/1976 | |
| SU | 0815051 | * | 3/1981 | ..... 148/578 |

OTHER PUBLICATIONS

Barron, R.F., (Louisiana Tech Univ.):"Cryogenic treatment of tool steels" Precision Metalforming Assoc., 1996, p. 535–548, Graphs, 6 Ref. Conference: Manufacturing Strategies, vol. 6, Nashville, TN, XP002179251.

C. Waldmann, "Cryogenic Tempering Extends Tool Life", Advanced Materials & Processes, Dec. 1994, pp. 63–64, Ohio.

P. Stratton, "Cryogenics Improve the Heat–Treatment of Steels", Metallurgia, Jan. 1998, pp. 7, 8, 10.

* cited by examiner

*Primary Examiner*—Sikyin Ip
(74) *Attorney, Agent, or Firm*—Bacon & Thomas

(57) ABSTRACT

A heat treatment method of steel is capable of enhancing wear resistance, mechanical properties and dimensional stability of the steel due to the reduction of the retained austenite amount to substantially zero. In the method, an article of the steel is subjected to a quenching and then subzero treatment including cooling it at a cooling rate of 1 to 10° C./min. to a cooling temperature and holding the cooling temperature for a predetermined period of time.

18 Claims, 1 Drawing Sheet

HEAT TREATMENT METHOD OF STEEL

BACKGROUND OF THE INVENTION

1. Field of the Invention

The present invention relates to a heat treatment method of steel for improving dimensional stability, wear resistance and mechanical properties.

2. Description of the Related Art

A steel is generally subjected to a quenching to improve its hardness. Due to the quenching, the structure of the steel is transformed from austenite into martensite, to be hardened. It has also been known that the quenched steel having less retained austenite is more excellent in dimensional stability, mechanical properties and wear resistance (fatigue resistance). Hereinafter, the term "steel having excellent mechanical properties" means a steel that is less broken and cracked.

In order to further decrease the retained austenite, the quenched steel can be subsequently subjected to a tempering or sub-zero treatment.

The tempering uses the nature of the retained austenite that it is easily transformed into martensite through a high temperature treatment. Accordingly, the retained austenite starts decreasing when the steel is heated to a satisfactorily high temperature due to the tempering. For example, in case of SKH51 steel according to Japanese Industrial Standard, the retained austenite starts decreasing when the steel temperature reaches 500° C. or higher.

However, in case that the quenched steel is tempered at too high tempering temperature, there is a problem of lowering the steel hardness, thereby decreasing the wear resistance.

Alternatively, the subzero treatment can be performed after the quenching as described above. In the subzero treatment, the quenched steel is rapidly cooled to a temperature of lower than 0° C., also makes it possible to reduce the retained austenite in the steel, thereby giving an extremely enhanced hardness, wear resistance and dimensional stability (i.e., decreased age deformation) to the steel.

In the subzero treatment, solidified carbon dioxide (dry ice), liquid carbon dioxide (boiling point: −78° C.) or liquid nitrogen (boiling point: −196° C.) can be used as a cooling medium. In addition, as the subzero treatment equipment, any type can be used including types of cooling the quenched steel (i.e., "steel to be treated") by 1) immersing the steel to be treated into liquid nitrogen; 2) immersing the steel to be treated into a low temperature cooling medium such as dry ice-added ether and alcohol; 3) containing the steel to be treated in a vessel whose internal atmosphere has been cooled with a refrigerating machine; and 4) spraying liquid nitrogen or liquid carbon dioxide directly on the steel to be treated through a liquefied gas spray. The steel to be treated to the predetermined low temperature is then left at room temperature to raise the steel temperature to the ordinary temperature.

It should be noted that, in the technical field of heat treatment of steel, a high performance steel having excellent hardness, wear resistance and dimensional stability has been desired especially as materials for precise measurement and cutting tools and the like. With using such a cutting tool that is made of the high performance steel, a variety of machine parts (for example, driving members such as driving gears of automobiles and construction machines) can be manufactured.

As described above, the steel is conventionally subjected to the subzero treatment, which may be followed by the tempering, to decrease the retained austenite amount. However, the decrease is not sufficient for obtaining such a high performance steel that has excellent properties. Thus, a steel having a further decreased amount of the retained austenite has been desired. In addition, the conventional method of the subzero treatment has a problem that the steel to be treated is likely to be broken or cracked during the treatment.

To solve the problem, a heat treatment method is proposed by C. WALDMANN in ADVANCED MATERIAL & PROCESSES vol.146, No.6 (1994), p63–64. This method includes a subzero treatment in which the steel is cooled not rapidly but slowly to −195° C., held for 20 to 60 hours at the temperature, then recovered to +150° C. and slowly returned to room temperature. Another heat treatment method is proposed by P. STRATTION in METALLURGIA, vol.65, No.1(1998), p7–8. The subzero treatment of the another method includes cooling the steel slowly to −140° C. at a rate of 30° C./hr, keeping the temperature for a short time to transform the retained austenite of the steel and then recovering the steel slowly to room temperature.

According to these proposed methods, it is possible to suppress breaking and cracking of the steel. However, the retained austenite amount is not satisfactorily decreased.

Moreover, U.S. Pat. No. 5,259,200 describes a heat treatment method in which an article of steel is lowered over a liquid nitrogen bath until its temperature reaches about −70° C., lowered into the bath to cool the article to about −196° C., elevated out of the bath and again suspended over the bath to reach it slowly to about −70° C., and allowed to heat up to room temperature.

According to this method, although the breaking and cracking can be suppressed, it is difficult to decrease the retained austenite uniformly from the surface to the deep part of the article. This may allow a large amount of the retained austenite to exist locally in the article.

SUMMARY OF THE INVENTION

The present invention has been conceived in light of these problems, and it is an object of the present invention to provide a heat treatment method of steel that is capable of transforming all of the retained austenite and extremely enhancing the steel properties such as wear resistance, mechanical properties and dimensional stability.

According to the present invention, a heat treatment method of steel includes steps of quenching a steel article, cooling the steel article at a cooling rate of 1 to 10° C./min. to a cooling temperature, holding the steel article at the cooling temperature for a predetermined period of time and recovering the steel article to room temperature.

The cooling temperature is preferably −180° C. or lower. Alternatively, it may be −80° C. or lower when the heat treatment method further includes a step of tempering the steel article after recovering the steel article to room temperature.

It is preferred that the steel article is recovered to room temperature at a recovering rate of 1 to 10° C./min.

It is also preferred that the predetermined period of time in the step of holding the steel article is one minute or more.

DESCRIPTION OF THE PREFERRED EMBODIMENTS

Figure 1A:
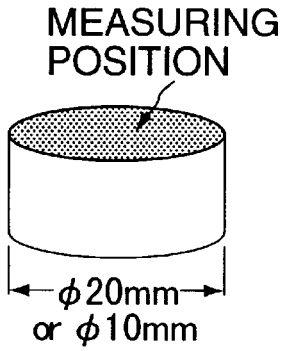
FIG. 1A is a schematic diagram showing a position of the steel article for measuring its retained austenite amount and hardness.

The inventors found that the retained austenite can be reduced to zero or a considerably less amount by adjusting the cooling rate of the subzero treatment (that is, when the steel is cooled at a predetermined rate that is neither too high nor too low in the subzero treatment, the retained austenite of the steel can be reduced to such an extent), and came up with the present invention.

The heat treatment method of steel according to the present invention includes a quenching and sub-zero treatment, and the sub-zero treatment includes a cooling step of cooling the steel to a cooling temperature of −180° C. or lower at a cooling rate of 1 to 10° C./min. and a cooling temperature holding step for holding the cooling temperature.

In such a subzero treatment following the quenching, the retained austenite amount contained in the steel article can be reduced to substantially zero by controlling the cooling rate to 1 to 10° C./min. and the cooling temperature to −180° C. or lower. In addition, the retained austenite in the steel article can be reduced to a considerably small amount by controlling the cooling rate to 1 to 10° C./min. and cooling the steel to −80° C. or lower. In this case, the following tempering makes it possible to reduce such a small amount of the retained austenite remained after the subzero treatment to substantially zero.

By the reduction of retained austenite to substantially zero, provided can be steel products having excellent wear resistance, mechanical properties and dimensional stability and, furthermore, having no or little crack and deformation therein.

The cooling rate is described in detail in the followings. In case of the conventional rapid-cooling to −196° C. simply by immersing an article of steel into liquid nitrogen, the surface part of the steel article immediately starts being cooled, whereas the deep part starts after a severe delay. This is likely to prevent a uniform martensite transformation of the retained austenite throughout the steel article, resulting in distortion therein, which may cause a crack and deformation. Alternatively, the non-uniform transformation may give a non-uniform steel product that locally has a large amount of the retained austenite. On the other hand, in case of controlling the cooling rate to 10° C./min. or less, such a slow cooling does not cause a severe difference of cooling between the surface part and the deep part of the steel article. As a result, the martensite transformation progresses uniformly throughout the steel article, and finally all of the retained austenite can be transformed. More preferably, the cooling rate is 5° C./min. or less.

However, when the cooling rate is too low, i.e., 1° C./min. or less, the retained austenite is likely to be stabilized before the steel article temperature reaches to the predetermined cooling temperature. This suppresses the smooth martensite transformation, thereby decreasing the effect of reduction of the retained austenite due to cooling. The cooling rate is, therefore, preferably 1° C./min. or more and more preferably 2° C./min. or more.

When the cooling rate, depending on the shape and size of the steel article to be treated, is within the preferable range of 1 to 10° C./min., the uniform martensite transformation throughout the steel article, i.e., up to the deepest part, can be achieved regardless of size or shape of the steel article. For instance, even if the steel article has a large size of, for example, 300 mm×300 mm×2000 mm, such an uniform transformation can be realized.

The cooling rate is preferred to be kept constant, because lowering temperature at a constant rate makes a further uniform martensite transformation possible.

According to the present invention, the preferable cooling temperature (i.e., a temperature that the steel article reaches when the cooling step is completed), in case that the subzero treatment is not followed by the tempering, is −180° C. or lower as described above. This is because, if the cooling temperature is higher than −180° C., a small amount of the retained austenite is likely to be remained (i.e., left un-transformed) after the subzero treatment.

On the other hand, in case that the subzero is followed by the tempering, the preferable cooling temperature is −80° C. or lower, which is higher than that in the former case. This is because such a cooling reduces the retained austenite to a considerably small amount and the small amount of the retained austenite can be completely transformed into martensite by the following tempering, resulting in the steel products substantially free of retained austenite. In this case (i.e., the case that the subzero treatment is followed by the tempering), the cooling temperature is more preferably −150° C. or lower for a further reduction of the retained austenite. It is also possible to subject the steel article to the tempering after it is cooled to −180° C. or lower in the subzero treatment.

When the cooling temperature is set to lower than −180° C., in the following step for holding the cooling temperature, the low temperature liquefied gas may liquefied in the subzero treatment vessel, which leads difficulty in the precise temperature control for holding the cooling temperature constant. On the other hand, when the cooling temperature is −180° C. or higher, the low temperature liquefied gas such as liquid nitrogen in a liquid state is prevented from pooling in the vessel for the subzero treatment without being vaporized. Therefore, the precise temperature control in the vessel can be easily made. Accordingly, if the tempering is performed after the sub-zero treatment, the cooling temperature is preferably within the range from −80° C. to −180° C. from the above-described standpoint.

According to the present invention, it is preferred to further perform a recovering step of raising the steel temperature up to room temperature at a recovering rate of 1 to 10° C./min. in the vessel after the cooling temperature holding step.

The reasons are explained in the followings. A magnitude of thermal stress (compressive stress) produced in the steel by the cooling depends on the cooling rate. That is, the rapid cooling results in a large compressive stress, whereas the slow cooling results in a small compressive stress. To cancel the compressive stress, it is preferred that the recovering rate in the recovering step is set at the approximately same value as the cooling rate. Accordingly, when the recovering rate is 1 to 10° C./min. as described above, the compressive stress produced in the cooling step can be satisfactorily cancelled, thereby suppressing the steel distortion. The recovering rate is not necessary to be strictly equal to the cooling rate. If it is within the above-mentioned range, it is sufficient for canceling the compressive stress resulting from cooling at a cooling rate of 1 to 10° C./min. In addition, the recovering rate is, depending on the shape, weight and size of the steel article, more preferably 2° C./min. or more and 5° C./min. or less.

Moreover, according to the present invention, a period of time for which the steel article is held at the cooling temperature in the cooling temperature holding step (referred to as "holding time" hereinafter) is preferably 1 minute or more.

The required holding time of the cooling temperature holding step depends on the shape, weight, size and the like of the steel article. However, for example when the steel article has a size of 20 mm (diameter)×20 mm (thickness), which is a common size as the steel for precise measurement and cutting tools and the like, such a holding time as 1 minute or more is sufficient for completing the uniform martensite transformation without giving almost no temperature difference between the surface part and deep part of the steel article. The more preferable holding time is 5 minute or more.

When treating a relatively small steel article, it is not necessary to hold the cooling temperature for such a long time as 1 minute or more. This is because the uniform martensite transformation can be completed even with a shorter holding time than 1 minute.

On the other hand, when the holding time is too long, the steel productivity is likely to be lowered. From this point of view, the holding time is preferably 60 minute or less and more preferably 30 minute or less.

The heat treatment method according to the present invention can effectively applied for a high speed tool steel. In this case, the method particularly gives a remarkable effect of reducing the retained austenite. The present invention therefore is desirable especially from the viewpoint of manufacturing a high speed tool steel cutting tool.

EXAMPLE 1

A high speed tool steel (SKH 51 steel according to Japanese Industrial Standard) was used as a raw material. The steel was formed into a test piece having a diameter of 20 mm and a thickness of 20 mm and, in addition, a sample drill for cutting tool having a diameter of 6.0 mm and a length of 100 mm. The test piece and sample drill were then subjected to an oil hardening at 1225° C. for 2 minutes in a heat treating furnace (quenching treatment).

Subsequently, in a subzero treatment equipment, the quenched test piece and sample drill were cooled to a cooling temperature of −180° C. at a cooling rate of 1.0° C./min., held at the cooling temperature for 60 minutes, and recovered to room temperature at a recovering rate of 1.0° C./min. (subzero treatment). Thereafter, the test piece and sample drill were transferred into a heat treating furnace to subject them a single tempering at 550° C. for 90 minutes.

EXAMPLE 2

A test piece and sample drill were formed and subjected to the quenching in the same manner as in example 1. Then, the quenched test piece and sample drill were immersed into liquid nitrogen to rapidly cool them to a cooling temperature of −196° C. and then held at the cooling temperature for 60 minutes. The cooling rate was determined about 40 to 200° C./min. from the fact that the test piece and sample drill was cooled to the same temperature as the liquid nitrogen in 1 to 5 minutes. The cooled test piece and sample drill were then withdrawn from the liquid nitrogen, followed by still standing in outside air to recover them to ordinary temperature. The recovering took a half to one day. Thereafter, the test piece and sample drill were transferred into a heat treating furnace for a single tempering at 550° C. for 90 minutes.

EXAMPLE 3

A test piece and sample drill were formed and subjected to the quenching in the same manner as in example 1. The quenched test piece and sample drill were then tempered without subjecting them to any subzero treatment. In the tempering of this example, the test piece and sample drill were twice tempered at 550° C. for 90 minutes with using a heat treating furnace.

[Measurements and Results of Examples 1 to 3]

Figure 1B:
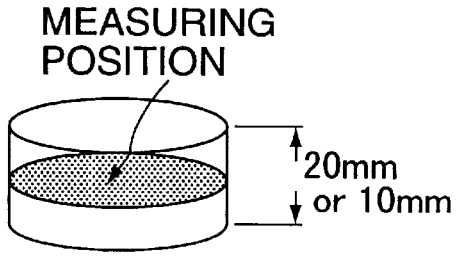
FIG. 1B is a schematic diagram showing a position of the steel article for measuring its retained austenite amount and hardness.

As to the respective treated test pieces of example 1 to 3, the hardness was measured with Vickers hardness meter and the retained austenite amount was obtained by X-ray analysis. The measuring positions of the test piece for the hardness measurement and the X-ray analysis were the middle of the upper surface part of the test piece (shown in FIG. 1A) and the middle of the deep part, i.e., the middle at the middle point in thickness (shown in FIG. 1B).

In addition, the treated sample drill of respective examples was subjected to a cutting (i.e., drilling) test. In the test, a S50C steel according to Japanese Industrial Standard was drilled with the treated sample drill at a drilling rate of 30 m/min. and a traverse speed of 0.2 mm/rev. The drilling depth was set to 16 mm. The test was continued until the treated sample drill became unusable and the drilling number (i.e., hole number) during the test was obtained for the evaluation of its wear resistance and mechanical properties.

The results were shown in table 1.

TABLE 1

| | Hardness (Hv) | | Retained austenite amount (wt %) | | Cutting test |
|---|---|---|---|---|---|
| | Surface part | Deep part | Surface part | Deep part | Drilling number (Number of holes) |
| Ex.1 | 860 | 860 | 0.0 | 0.0 | 1000 |
| Ex.2 | 860 | 860 | 0.2 | 0.3 | 550 |
| Ex.3 | 860 | 860 | 0.3 | 0.3 | 500 |

As is apparent from table 1, the treated test pieces of examples 1 to 3 had almost same hardness. However, this results also reveals that both of the treated test pieces of examples 2 and 3 had a small amount of retained austenite, whereas that of example 1 had no retained austenite in any of the surface part and deep part. This means, the heat treatment of example 1 makes possible to transform all of the retained austenite to martensite throughout the test piece (from its surface part to deep part).

Moreover, in the cutting test, the drilling number in example 1 was about twice greater than those in examples 2 and 3. This results proved that the treated sample drill of example 1 has a life twice as long as those of example 2 and 3. In the other words, the treated sample drill of example 1 has higher wear resistance and mechanical properties than the others.

EXAMPLE 4

A high speed tool steel (SKH 51 steel according to Japanese Industrial Standard) was used as a raw material. The steel was formed into a test piece having a diameter of 20 mm and a thickness of 20 mm and, in addition, a sample shaving cutter (a cutting tool) having an outside diameter of 240 mm, a central hole diameter of 63.5 mm and a thickness of 20 mm. In a heat treating furnace, the test piece and sample shaving cutter were then subjected to a quenching at 1220° C. for 20 minutes, followed by cooling with pressurized nitrogen gas.

As in case with example 1, in a subzero treatment equipment, the quenched test piece and sample shaving cutter were then cooled to a cooling temperature of −180° C. at a cooling rate of 1.0° C./min., held at the cooling temperature for 60 minutes, and recovered to room temperature at a recovering rate of 1.0° C./min. (subzero treatment). Thereafter, the test piece and sample shaving cutter were transferred into a heat treating furnace to subject them a single tempering at 550° C. for 90 minutes.

EXAMPLE 5

A test piece and sample shaving cutter were formed and subjected to the quenching in the same manner as in example 4. The quenched test piece and sample shaving cutter were then tempered without being subjected to any subzero treatment. In the tempering treatment of this example, the test piece and sample shaving cutter were twice tempered at 550° C. for 90 minutes with using a heat treating furnace.

EXAMPLE 6

A test piece was formed and subjected to the quenching in the same manner as in example 4. The quenched test piece was then tempered without being subjected to any subzero treatment. In the tempering treatment of this example, the test piece was once tempered at 550° C. for 90 minutes with using a heat treating furnace.

EXAMPLE 7

A test piece and sample shaving cutter were formed and subjected to the quenching in the same manner as in example 4. Then, the quenched test piece and sample drill were immersed into liquid nitrogen to rapidly cool them to a cooling temperature of −196° C. and held at the cooling temperature for 60 minutes. The cooling rate in this cooling step was about 40 to 200° C./min., which was determined from the fact that the test piece and sample shaving cutter was cooled to the same temperature as the liquid nitrogen in 1 to 5 minutes. The cooled test piece and sample shaving cutter were withdrawn from the liquid nitrogen, followed by still standing in outside air to recover them to ordinary temperature. The recovering took a half to one day. Thereafter, similarly with example 4, the test piece and sample shaving cutter were transferred into a heat treating furnace to perform a single tempering at 550° C. for 90 minutes.

[Measurements and Results of Examples 4 to 7]

As to the respective treated test pieces of examples 4 to 7, the retained austenite amount was obtained by X-ray analysis in the same manner as in examples 1 to 3. The measurement position of the test piece for the analysis was also same as those in examples 1 to 3, i.e., the middle of the upper surface part of the test piece (shown in FIG. 1A) and the middle of the deep part, i.e., the middle at the middle point in thickness (shown in FIG. 1B).

In addition, the treated sample shaving cutter of respective examples 4 and 5 was worked to obtain a final product. In the working, the upper and lower surfaces were abraded and then the central hole was worked and abraded (i.e., the hole side wall was abraded). As to the final product, a shaving cutter center hole diameter was measured with an air micrometer. The measurement was performed immediately after the working to obtain a reference value. A month, three months and six months after the working, the same measurements were performed. Then, the difference between the respective measured values of one, three and six months after the working and the reference value was obtained as an over size of the hole diameter (i.e., the dimensional change of the hole).

The results were shown in table 2.

TABLE 2

| | Retained austenite amount (wt %) | | Over size of shaving cutter hole diameter (μm) | | |
|---|---|---|---|---|---|
| | Surface part | Deep part | After 1 month | After 3 month. | After 6 month. |
| Ex.4 | 0.0 | 0.0 | 1.0 | 1.5 | 2.0 |
| Ex.5 | 0.3 | 0.5 | 2.0 | 6.0 | 7.0 |
| Ex.6 | 3.0 | 3.0 | — | — | — |
| Ex.7 | 0.3 | 0.5 | — | — | — |

It was found from the results that the test pieces of examples 5 to 7 (comparative examples) had some amounts of the retained austenite, whereas that of example 4 (inventive example) had no retained austenite in both the surface and deep parts thereof.

According to the dimensional standard on a shaving cutter hole diameter, it is permissible that the hole diameter has a dimensional change of within 5 μm. However, the dimensional change in example 5 reached beyond 5 μm after three months. On the contrary, the dimensional change in example 4 was not beyond 5 μm even after six months. The reasons were considered as follows. The sample shaving cutter of example 5 was subjected to the age-deformation due to the retained austenite. On the other hand, the sample shaving cutter of example 4 did not had a large dimensional difference, because such retained austenite was not found in not only the surface part but also the deep part. This means that the sample shaving cutter of example 4 was considerably excellent in the dimensional stability.

In addition, the results reveals a part of the retained austenite remained in the treated sample shaving cutters of examples 6 and 7. It is surmised from this point of view that the sample shaving cutters also should be changed in dimensions.

EXAMPLE 8

A cold tool steel (SKD 11 according to Japanese Industrial Standard) was used as a raw material. The steel was formed into a test piece (20 mm×30 mm×10 mm (thickness)). In a heat treating furnace, the test piece was subjected to a quenching at 1050° C. for 15 minutes, followed by cooling in air.

Subsequently, the quenched test piece was cooled to a cooling temperature of −180° C. at a cooling rate of 2° C./min., held at the cooling temperature for 60 minutes, and recovered to room temperature at a recovering rate of 2° C./min. (subzero treatment).

[Wearing Test and Result in Example 8]

Figure 2:
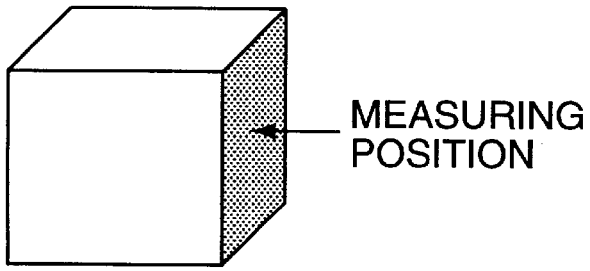
FIG. 2 is a schematic diagram showing a position of the steel article for a hardness measurement.

The treated test piece of example 8 was then subjected to a wearing test (Ogoe wearing test). The position of the test piece for the hardness measurement of the wearing test is shown in FIG. 2. In the wearing test, a friction velocity, a friction distance and a terminal load were respectively adjusted to 1.96 m/sec., 400 m and 61.7 N (6.3 kgf), and a S50C steel was used as a material for giving such a friction to the treated test piece.

The result shows that the steel (treated test piece) of example 8 had a surface hardness of 880 $H_v$ and a wear amount of 0.3 $mm^3$ after the wearing test. Such a small wear amount proves that the steel has satisfactorily high wear resistance.

EXAMPLES a to j

A high speed tool steel (SKH51) and cold tool steel (SKD11) were used as raw materials. The respective steel was formed into test pieces having a diameter of 10 mm and a thickness of 10 mm. Each of the test piece was then subjected to the quenching and subzero treatment under such conditions as shown in table 3.

[Measurements and Results in Examples a to j]

As to the respective treated test pieces of examples a to j, the retained austenite amount was measured in the same manner as in examples 1 to 3. The measuring positions of the test piece for the hardness measurement and the X-ray analysis were the middle of the upper surface part of the test piece (shown in FIG. 1A) and the middle of the deep part, i.e., the middle at the middle point in thickness (shown in FIG. 1B).

The results of these examples were also shown in table 3.

TABLE 3

| | | conditions of quenching | | | Conditions of subzero treatment | | | | Retained austenite amount After subzero treatment before tempering | |
|---|---|---|---|---|---|---|---|---|---|---|
| | Steel (JIS) | Quenching temp. (° C.) | Holding time of quenching temp. (min.) | Quenching type | Cooling rate (° C./min.) | Cooling temp. (° C.) | Low temp. holding time (min.) | Recovering rate (° C./min.) | Surface part (wt %) | Deep part (wt %) |
| Ex.a | SKH51 | 1220 | 2.5 | Oil quenching | 0.05 | −180 | 60 | 1 | 15 | 16 |
| Ex.b | SKH51 | 1220 | 2.5 | Oil quenching | 1 | −180 | 60 | 1 | 0 | 0 |
| Ex.c | SKH51 | 1220 | 2.5 | Oil quenching | 25 | −180 | 60 | 1 | 12 | 16 |
| Ex.d | SKH51 | 1220 | 2.5 | Oil quenching | 2 | −180 | 60 | 1 | 0 | 0 |
| Ex.e | SKH51 | 1220 | 2.5 | Oil quenching | 10 | −150 | 120 | 1 | 4 | 5 |
| Ex.f | SKHS1 | 1220 | 2.5 | Oil quenching | 20 | −150 | 120 | 1 | 12 | 16 |
| Ex.g | SKD11 | 1050 | 15 | Air hardening | 2 | −180 | 60 | 1 | 0 | 0 |
| Ex.h | SKH11 | 1050 | 15 | Air hardening | 15 | −180 | 60 | 1 | 8 | 12 |
| Ex.i | SKD11 | 1220 | 2.5 | Oil quenching | About 40~200*1 | −196 | 60 | (low)*2 | 13 | 18 |
| Ex.j | SKD11 | 1050 | 15 | Air hardening | About 40~200*1 | −196 | 60 | (low)*2 | 14 | 18 |

*1The cooling rate(about 40~200° C./min.) was obtained by immersing the steel piece to liquid nitrogen.
*2In this case, it took a half or 1 day to recover the cooled steel piece from the cooling temperature to room temperature by still standing at room temperature.

The results in table 3 proves the treated test pieces of examples b, d and g, which had been cooled at a cooling rate of 1 or 2° C./min. to a cooling temperature of −180° C. and held at the cooling temperature for 60 minutes in the subzero treatment, had no retained austenite remained in any of the surface and deep parts. On the contrary, both in case of lower cooling rate than those in examples b, d, g (i.e., in case of example a) and in case of higher cooling rate than those in examples b, d, g (i.e., in case of examples c, f, h, i and j), there existed a large amount of the retained austenite in both the surface and deep parts of the test pieces. Further, in case of the cooling temperature of the subzero treatment being −150° C. (example e), there existed a small amount of the retained austenite in the test piece.

EXAMPLES k to r

The same raw materials as examples a to c and e to i were used as raw materials in examples k to r respectively, to form test pieces. Each of the test pieces was then subjected to a quenching and subzero treatment in the same manner as in respective examples a to c and e to i. The obtained test pieces of examples k to r was tempered thereafter. The heat treatment conditions of the tempering were shown in table 4.

[Measurements and Results in Examples k to r]

As to the respective treated test pieces of examples k to r, the retained austenite amount was measured in the same manner as in examples 1 to 3. The measuring positions of the test piece for the hardness measurement and the X-ray analysis were the middle of the upper surface part of the test piece (shown in FIG. 1A) and the middle of the deep part, i.e., the middle at the middle point in thickness (shown in FIG. 1B).

The results of these examples were also shown in table 4.

TABLE 4

| | | Conditions of tempering | | | Retained austenite amount after tempering | |
|---|---|---|---|---|---|---|
| | Conditions of quenching and subzero treatment | Tempering temperature (° C.) | Holding time of tempering temperature (min.) | Number of tempering | Surface part (wt %) | deep part (wt %) |
| Ex.k | Same as those in Ex.a | 550 | 90 | 1 | 0.3 | 0.4 |
| Ex.l | Same as those in Ex.b | 550 | 90 | 1 | 0 | 0 |
| Ex.m | Same as those in Ex.c | 550 | 90 | 1 | 0.4 | 0.8 |
| Ex.n | Same as those in Ex.e | 550 | 90 | 1 | 0 | 0 |
| Ex.o | Same as those in Ex.f | 550 | 90 | 1 | 0.3 | 0.5 |

TABLE 4-continued

| | Conditions of quenching and subzero treatment | Conditions of tempering: Tempering temperature (° C.) | Holding time of tempering temperature (min.) | Number of tempering | Retained austenite amount after tempering: Surface part (wt %) | deep part (wt %) |
|---|---|---|---|---|---|---|
| Ex.p | Same as those in Ex.g | 200 | 90 | 1 | 0 | 0 |
| Ex.q | Same as those in Ex.h | 200 | 90 | 1 | 5 | 10 |
| Ex.r | Same as those in Ex.i | 550 | 90 | 1 | 0.3 | 0.4 |

It can be understood from the results of examples e and n that, although the test piece of example e without tempering had a small amount of the retained austenite, the test piece of example n with tempering after the same treatments as those of example e was free of no retained austenite. In addition, each test piece of examples k, m, o, q and r had a reduced amount of the retained austenite in comparison with that of the respective corresponding examples (examples a, c, f, h and i), but there still existed therein. Moreover, in examples 1 and p corresponding to examples b and g, no retained austenite was remained. This means that the retained austenite amounts in examples b and g were kept zero before and after the tempering.

Although the heat treatment method according to the present invention has been fully described by way of examples, it is to be understood that various changes and modifications will be apparent to those skilled in the art. Therefore, unless otherwise such changes and modifications depart from the scope of the present invention, they should be construed as being included therein.

As described above, the heat treatment method of steel according to the present invention includes subjecting the article of steel to the quenching and then the subzero treatment in which the article is cooled at a cooling rate of 1 to 10° C./min. to a cooling temperature of −180° C. or lower. Alternatively, it includes subjecting the steel article to the quenching, subzero treatment and then tempering. In the subzero treatment of this case, the steel article is cooled at a cooling rate of 1 to 10° C./min. to a cooling temperature of −80° C. or lower.

This method can reduce the retained austenite amount in the steel to substantially zero, resulting in extremely enhanced mechanical properties, wear resistance and dimensional stability of the steel. This effect of the enhancement is significant especially in case of using high speed tool steels and, accordingly, makes possible to provide a high performance high speed tool steel precise measurement tool, high speed tool steel cutting tool and the like.

This application is based on Japanese Application Serial No.2000-186479 filed in Japanese Patent Office on Jun. 21, 2000, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A heat treatment method of steel comprising steps of:

quenching a steel article;

cooling the steel article at a substantially constant cooling rate of 1 to 10° C./min. to a cooling temperature;

the cooling rate is constant at least from room temperature to −180° C. without isothermal holding;

holding the steel article at −180° C. or lower for a period of time; and recovering the steel article to room temperature.

2. The heat treatment method according to claim 1, wherein the period of time is one minute or more.

3. The heat treatment method according to claim 2, wherein the steel article is recovered to room temperature at a recovering rate of 1 to 10° C./min.

4. The heat treatment method of claim 2 wherein the period of time is in the range of 1 minute to 60 minutes.

5. A heat treatment method for steel to reduce austenite content in the steel comprising the steps of:

quenching a steel article;

selecting a cooling rate for cooling said article, said cooling rate being in the range of 1–10° C./min;

cooling the quenched steel article to a cooling temperature of −180° C. or lower while maintaining said cooling rate at a constant level continuously throughout cooling to the cooling temperature to reduce the amount of austenite in the steel to substantially zero;

holding the steel article at the cooling temperature for a period of time; and recovering the steel article to room temperature.

6. The heat treatment method of claim 5 wherein there is uniform martensite transformation throughout the steel article.

7. The heat treatment method of claim 5 wherein the cooling temperature is −180° C.

8. The heat treatment method of claim 5 wherein the recovering rate of the steel article from the cooling temperature to room temperature is 1–10° C./min.

9. The heat treatment method of claim 5 wherein the period of time is from 1–60 minutes.

10. The heat treatment method of claim 5 wherein the cooling rate is 2° C./min to −180° C. or lower.

11. The heat treatment method of claim 5 wherein the recovery rate is from 2° to 5° C./min. to −180° C. or lower.

12. The heat treatment method of claim 5 wherein the recovering rate of the steel article to room temperature is the same as the rate of cooling to −180° C. or lower.

13. The heat treatment method of claim 12 wherein the cooling rate is 2° C./min.

14. The heat treatment method of claim 12 wherein the cooling rate is 5° C./min.

15. In a process for heat treating steel comprising quenching the steel cooling the steel, and recovering the steel to room temperature, wherein the improvement comprises cooling the quenched steel to a temperature of −180 ° C. or lower using a constant cooling rate in the range of 1–10° C./min which cools said steel at a constant rate throughout the cooling process to reduce the austenite content of the steel to substantially zero and holding the cooled steel at a temperature of −180° C. or lower for from 1 to 60 minutes before recovering said steel to room temperature.

16. The process of claim 15, wherein the cooling rate is 2°–5° C./min.

17. The process of claim 15, wherein the holding time is 60 minutes.

18. The heat treatment process of claim 15 wherein the recovering rate of the steel article to room temperature is the same as the rate of cooling to −180° C. or lower.

* * * * *